United States Patent [19]

Gaston et al.

[11] 4,216,718

[45] Aug. 12, 1980

[54] MECHANISM FOR ADJUSTING BLANKET-TO-BLANKET SQUEEZE OF PERFECTING PRESS

[75] Inventors: Harold W. Gaston; Ronald D. Welborn; Samuel G. Humphreys, all of Emporia, Kans.

[73] Assignee: Didde-Glaser, Incorporated, Emporia, Kans.

[21] Appl. No.: 903,665

[22] Filed: May 8, 1978

[51] Int. Cl.[2] ..... B41F 7/02; B41F 7/12

[52] U.S. Cl. ..... 101/144; 101/229; 101/247

[58] Field of Search ..... 101/247, 220, 221, 225, 101/217, 218, 182, 185, 137, 139, 138, 140, 143, 144, 145, 352, 141, 142, 229, 230, 231; 100/168, 169, 170, 176, 158 R; 68/244, 250, 251, 253 R, 256, 257, 260, 262 R, 263 R, DIG. 3; 81/64, 65; 269/229, 230, 231, 235, 237, 241, 196; 118/114, 115

[56] References Cited

U.S. PATENT DOCUMENTS

| | | | |
|---|---|---|---|
| 275,165 | 4/1883 | Donovan | 68/260 |
| 523,642 | 7/1894 | Mendenhall | 68/257 X |
| 612,391 | 10/1898 | Ballou | 269/241 X |
| 1,590,742 | 6/1926 | Goulding | 101/218 |
| 1,823,537 | 9/1931 | Gaudreau | 269/241 |
| 1,895,280 | 1/1933 | Currie | 81/64 X |
| 2,384,148 | 9/1945 | Yeager | 269/235 X |
| 2,804,015 | 8/1957 | Brougham | 101/247 |
| 2,991,545 | 7/1961 | Wuischpard | 81/64 X |
| 3,552,313 | 1/1971 | Jeschke | 101/218 |
| 3,568,594 | 3/1971 | Johnston et al. | 101/152 |
| 3,880,077 | 4/1975 | Glaser et al. | 101/247 X |
| 4,022,122 | 5/1977 | Moser et al. | 100/169 X |

FOREIGN PATENT DOCUMENTS

| | | | |
|---|---|---|---|
| 25387 | 7/1883 | Fed. Rep. of Germany | 68/257 |
| 66182 | 2/1892 | Fed. Rep. of Germany | 68/257 |
| 27185 | 3/1897 | Fed. Rep. of Germany | 68/257 |
| 13576 | of 1885 | United Kingdom | 68/257 |

*Primary Examiner*—J. Reed Fisher

*Attorney, Agent, or Firm*—Schmidt, Johnson, Hovey & Williams

[57] ABSTRACT

The squeeze of two opposed paper-receiving rolls of an offset printing press may be infinitely adjusted within a relatively small range by virtue of the fact that each end plate supporting the rolls has a slit therein between the axes of rotation of the rolls which will permit slight deformation of the plate in a direction transversely of the slit upon manipulation of an adjusting mechanism to shift the rolls toward and away from each other. Adjustment mechanism is provided on each plate and includes a cam that, when rotated by the longitudinal displacement of an operating link, has the effect of opening or closing a corresponding slit to thereby effect minute adjustment of the spatial relationship of the roll axes. The operating link has a specially threaded section from which the longitudinal displacement of the link is derived, the arrangement being such that the ratio of link rotation to link displacement is relatively high so that very fine adjustment of the critical roll relationship can be achieved.

13 Claims, 6 Drawing Figures

MECHANISM FOR ADJUSTING BLANKET-TO-BLANKET SQUEEZE OF PERFECTING PRESS

This invention relates to lithographic printing process and particularly to improved mechanism adjustably mounted opposed rolls of a press which receive the paper to be printed, therebetween allowing the operator to make minute adjustments in the spacing of the axes of rotation thereof as may be necessary to compensate for different paper thickness.

The "squeeze" of opposed rolls with respect to one another and thereby with respect to the paper being printed is extremely critical insofar as print quality is concerned. A host of other variables including, for example, roll speed, ink characteristics, water quality, temperature, humidity, and paper characteristics likewise affect the print quality on the finished product. And in color work, as opposed to black and white printing, properly controlling these variables is far more critical with respect to print quality.

Thus, it becomes essential for the printer to be able to adjust, vary and regulate these variables to the extent that he can control the character and quality of the printed work produced on the press. In the case of blanket roll squeeze, however, he has not heretofore had the degree of sophisticated control that will permit him to obtain the desired quality. For example, in a so-called "perfecting" press, where both sides of the paper are printed simultaneously upon passing between a pair of opposed blanket cylinders, the squeeze of such cylinders has been rather crudely determined by placing circumferentially extending paper shims of known thickness around the outer blankets of such cylinders and thereby the periphery of the cylinders themselves so that the distance between the opposed blanket cylinders may be varied accordingly.

However, paper stock is available in only certain standard thicknesses so that the printer's adjustment is dependent upon and limited by the standard paper thicknesses. Consequently, although most desirably the spatial relationship between the two blanket cylinders might require dimensional adjustment in an amount far less than the minimum standard paper thickness, he has heretofore had no suitable way of making that type of fine adjustment, and has thus been forced to accept something less than the ultimate in print quality.

Moreover, not all printing jobs are carried out on the same type or thickness of paper. Thus, it becomes especially important that the printer have the ability to quickly and easily adjust the roll relationships to accommodate a different paper thickness and/or paper quality. In other words, the printer must be afforded a very high degree of flexibility insofar as dealing with all of the many variables are concerned, and heretofore a surprising amount of the desired flexibility has been lacking in the art. The present invention is directed to a way of providing that flexibility.

Accordingly, one important object of the present invention is, as above-stated, to provide an improved means by which the printer can adjust and control print quality through the manipulation of a variable heretofore only crudely controllable, i.e., the squeeze between two rolls such as the blanket cylinders of a perfecting press.

Another important object is to provide, in conjunction with the squeeze adjustment flexibility, a way of quickly yet accurately accommodating all of the various paper thicknesses that may be encountered by a printer during successive production runs.

A further important object of the present invention is to provide, within a relatively narrow range, infinite adjustment of the spatial relationship between two cooperating rolls of a printing press, as opposed to adjustment only by certain predetermined increments such as is avaiable when using standard size paper shims.

Additionally, it is an important object of this invention to provide for fine adjustment in a way that is compatible with the arrangement for "throwing off" the rolls into substantial spaced-apart positions and returning the same to cooperating, working positions.

Still further, an important object of the invention is to adapt the roll-supporting frame for such minute, fine adjustment in a rather simple way that, while capable of providing the necessary roll displacement during adjustment, nonetheless does not sacrifice the strength, rigidity and immobility of parts that are so important to quality printing.

Figure 1:
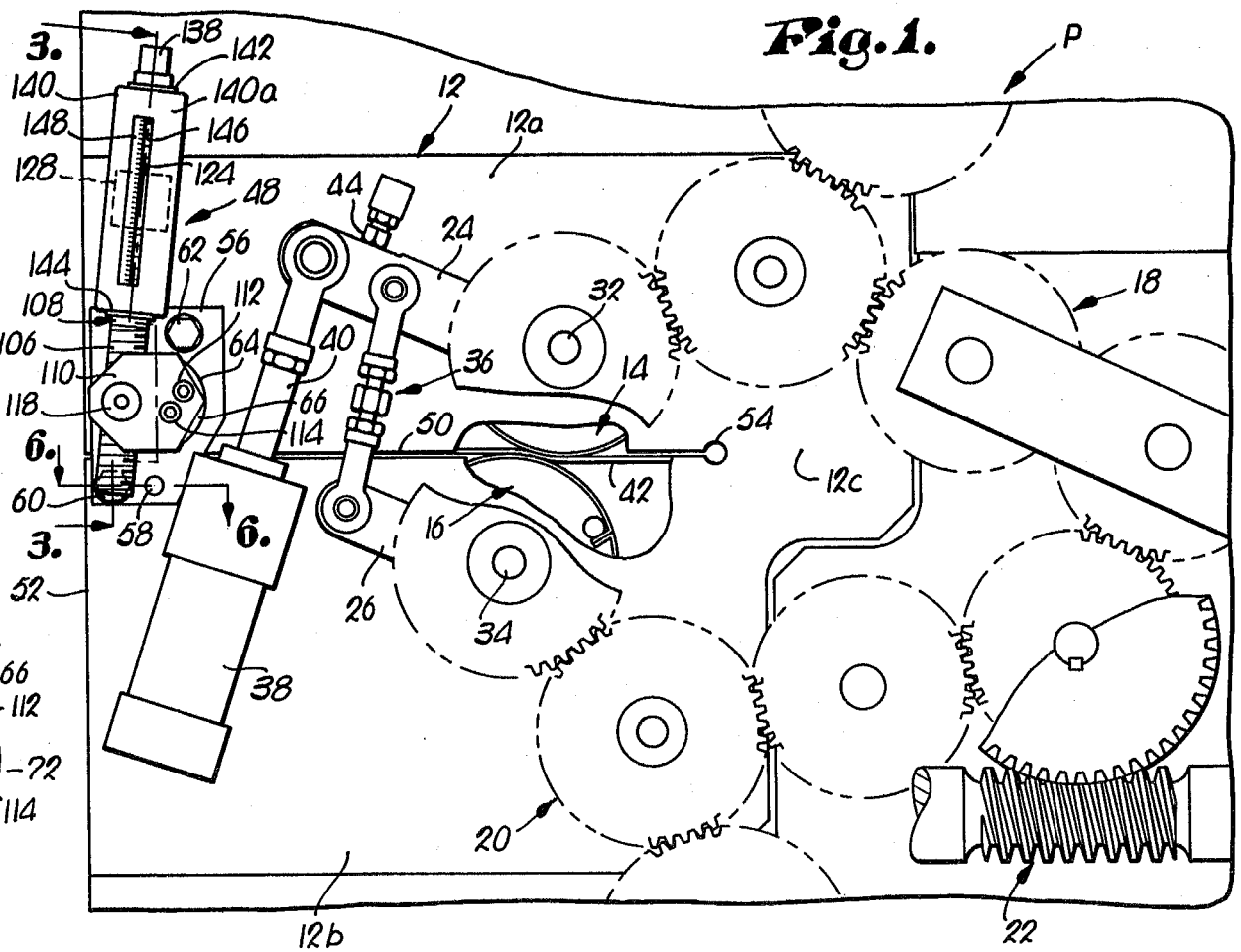
FIG. 1 is a fragmentary, side elevational view of one side of a perfecting press employing blanket-to-blanket paper squeeze-adjusting mechanism in accordance with the principles of the present invention with parts being broken away for clarity.

A press of the perfecting type broadly designated P in FIG. 1 of the drawings has a pair of spaced-apart frame structures including mounting plates 10 and 12 that support a number of interrelated, cooperable printing rolls and their associated drives, examples of which are the two opposed blanket cylinders 14 and 16. The drives for these two cylinders 14, 16 include a pair of gear trains 18 and 20 that are ultimately driven by a common worm 22.

The blanket cylinders 14 and 16 are not mounted directly on the plates 10 and 12, but are instead supported by upper and lower arms 24 and 26, respectively, at opposite ends of the cylinders 14 and 16, one pair only of the arms 24, 26 being illustrated. The arms 24 and 26 are in turn directly mounted on the frame plates 10 and 12 for vertical swinging movement about respective pivot points (not illustrated) adjacent to but eccentrically disposed with respect to the axes of rotation 32 and 34 of the cylinders 14, 16, respectively, so that swinging of the arms 24 and 26 may cause a vertical displacement of the axes 32 and 34 to thereby effect vertical displacement of the cylinders 14 and 16 themselves.

Each pair of arms 24, 26 on plates 10 and 12 has a turnbuckle 36 therebetween by which the angular relationship of corresponding arms 24, 26 with respect to each other is determined. By having the arms 24, 26 held in a slightly skewed relationship to one another, as opposed to a true parallel linkage arrangement, actuation of at least one air cylinder 38 connected to the outer end of a corresponding arm 24 will result in relative displacement of the cylinders 14, 16 toward and away from one another, depending upon the direction of movement of the rod 40 of the cylinder 38. It is to be understood in this respect that a single cylinder 38 may be used with associated linkage on the opposite side of the machine to maintain the required parallel relationship between rolls 14 and 16, or a pair of operating cylinders may be used, one on each of the plates 10 and 12 respectively. The displacement of the rod 40 of cylinder 38 is preferably such that the rolls 14 and 16 may be separated a sufficient distance to move out of contact with a sheet or web of paper 42 driven longitudinally between the opposed cylinders 14 and 16. As a consequence, the blanket cylinders 14 and 16 are held out of printing engagement with the paper 42 at that time. An upper limit stop 44 may be located within the path of travel of each upper arm 24 for use in conjunction with establishing the squeeze between various other rolls associated with the drive trains 18, 20.

Although the air cylinder 38 thus controls movement of the plate cylinders 14 and 16 relative to one another on a large-scale basis, this is insufficient in itself to provide the degree of exactness and adjustability required in the squeeze relationship between the cylinders 14 and 16. Two manually manipulable fine adjusting mechanisms 46 and 48 on opposite sides of the press provide flexibility not heretofore obtainable and eliminate the need for paper shimming of the blanket cylinders for different paper stock thickness.

It should first be noted that each of the plates 10, 12 has a horizontal passage in the nature of a slit 50 therein that extends from and outermost vertical edge 52 of the plate 10 or 12 inwardly to a remote, terminal hinge point 54 that in the illustrated arrangement is in the nature of a transverse bore slightly larger in diameter than the width of the slit 50. Thus, each of the frame plates 10 and 12 is effectively divided into a pair of upper and lower members or portions 10*a* and 10*b* or 12*a* and 12*b* located on opposite sides of the corresponding slit 50. Using the plate 12 as an example, the portion 12*a* is movable ever so slightly toward and away from portion 12*b* thereof in a direction transversely of the slit 50 through an arc having its axis of rotation located at the hinge point 54. That area of the plate 12 where the portions 12*a* and 12*b* are integrally interconnected on the side of the hinge point 54 opposite the slit 50 may be designated by the numeral 12*c* (likewise, of course, 10*c*) and provides yieldable resistance to such movement of the plate portions 12*a* and 12*b* with respect to one another.

Figure 6:
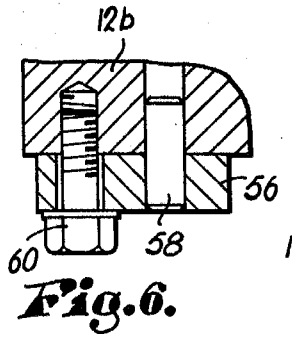
FIG. 6 is an enlarged, fragmentary cross-sectional view taken substantially on the line 6—6 of FIG. 1.
Figure 2:
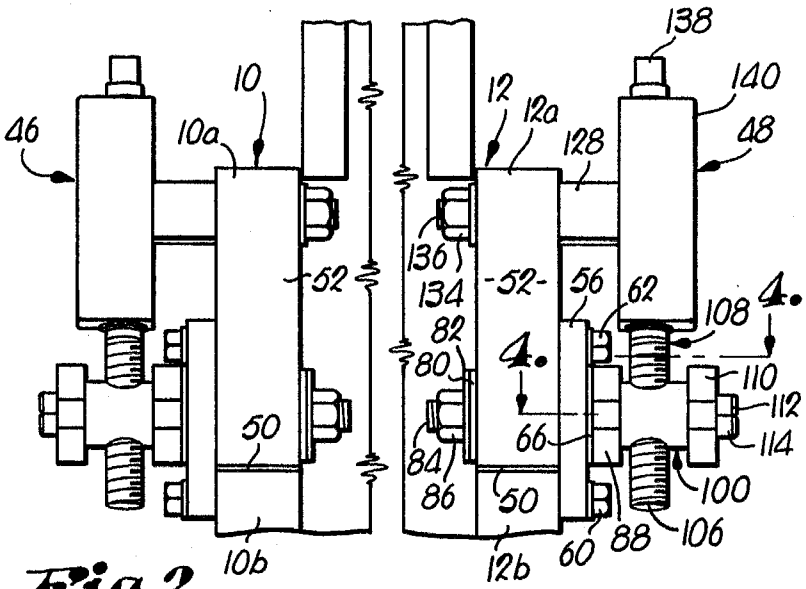
FIG. 2 is a fragmentary, end elevational view from the left end of the press as depicted in FIG. 1.

Inasmuch as the mechanisms 46 and 48 are identical, only the mechanism 48 will hereinafter be described in detail, it being fully understood, of course, that its principles of construction and operation apply equally as well to the mechanism 46. Part of the mechanism 48 includes a pentagonal block 56 (see FIGS. 1–3) releasably secured to the outer face of the plate portion 12*b*. In addition, a pivot pin 58 (FIGS. 1 and 6) fixes the position of plate 56 with respect to the lower plate portion 12*b*. A machine screw 60 passing through the block 56 and threaded into the portion 12*b* releasably clamps the lower part of block 56 against the portion 12*b*. Likewise, a second machine screw 62 adjacent the top of the block 56 passes through the latter and is threadably received by the plate portion 12*a* so as to releasably clamp the upper part of the block 56 against portion 12*a*.

Figure 5:
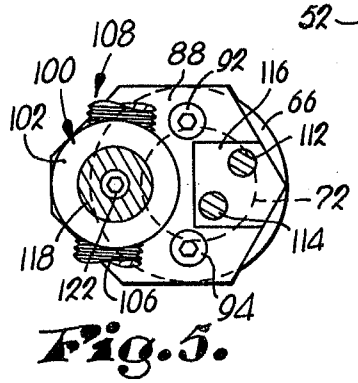
FIG. 5 is an enlarged, fragmentary, essentially cross-sectional view taken substantially on the line 5—5 of FIG. 3 with parts being omitted for additional clarity.

Somewhat centrally located within the plate 56 is a circular aperture 64 that rotatably and complementally receives head 66 of a cam 68 for rotation about a first axis 70 (FIG. 4) displaced from the axis of rotation of the main cam support shaft 72 that is rotatably received within a bore 74 through the upper frame portion 12*a*. It can best be seen from FIGS. 4 and 5 that the longitudinal axis 76 of the shaft 72 is eccentrically disposed with respect to the axis 70 of head 66 although the former coincides with the axis of the bore 74. An annular space 78 surrounds the shaft 72 between the head 66 and the proximal surface of the frame portion 12*a*. Likewise, at the opposite end of the shaft 72 an annular spacer 80 surrounds the shaft 72 between the proximal face of the frame portion 12*a* and a washer 82 received on a threaded, reduced diameter section 84 of the shaft 72. A nut 86 threaded onto the section 84 clamps the washer 82 against the spacer 80, but not so tightly as to absolutely preclude rotation of the shaft 72 under the application of a proper amount of rotative force thereto.

The mechanism 48 further includes calibrated, blanket-to-blanket bearer pressure adjustment mechanism (FIGS. 1 and 3) that makes a crank connection with the cam head 66 at a point disposed radially outwardly of the center thereof. An inner, hexagonal support block 88 is secured to the outer flat face of cam head 66 by a pair of mounting bolts 92 and 94 (FIG. 5) located on opposite sides of the axis of rotation of head 66. Block 88 is provided with a circular aperture 96 therein offset from the axis of cam head 66 as well as the axis of shaft 72 (see FIGS. 1 and 5) for receiving the stub end 98 of a pivot block 100 which has a main cylindrical body portion 102 provided with a transversely extending, internally threaded passage 104 which complementally receives one threaded end 106 of an actuating member in the nature of a differential screw broadly designated 108. A second hexagonal block 110 is secured to block 88 outboard of screw 108 by a pair of mounting bolts 112 and 114 which also extend through spacer 116 (FIGS. 3 and 5) which is of approximately the same length as the transverse thickness of body portion 102 of pivot block 100. The integral, cylindrical stub end 118 of block 100 opposite end 98 thereof, is pivotally received within a complemental opening 120 therefor in outer block 110. Set screw 122 extending axially through stub end 118 of block 100 compresses nylon plug 122*a* to engage threaded portion 106 of screw 108 and thus preclude undesired rotation thereof. The nylon plug provides a drag action on the screw rather than effecting a locking action thereon.

Figure 3:
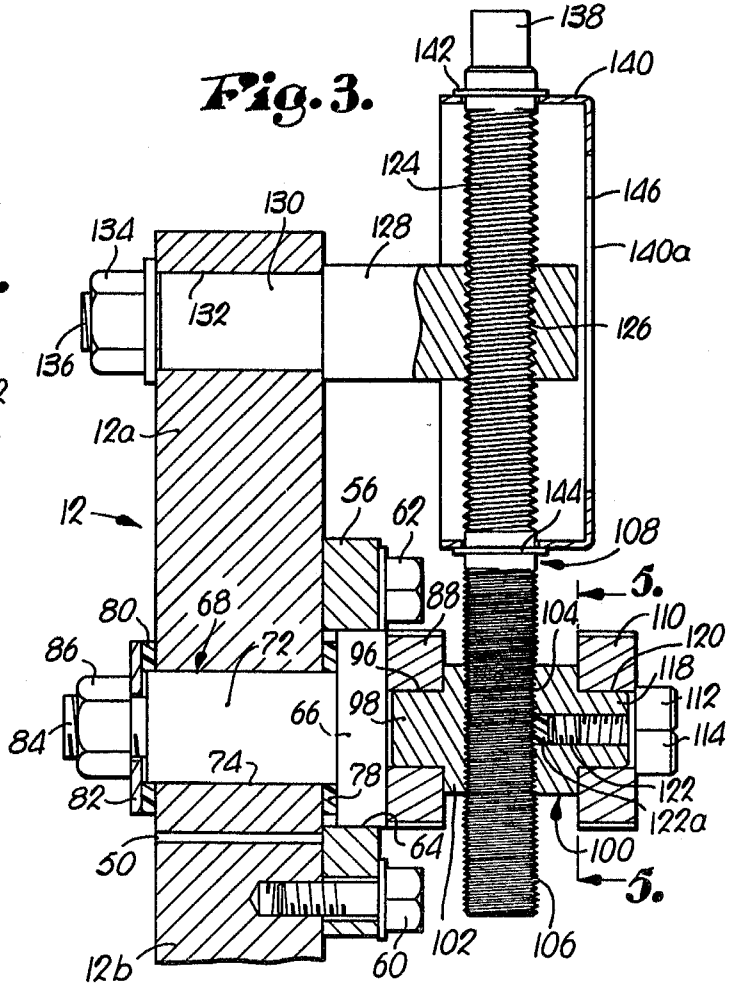
FIG. 3 is an enlarged, fragmentary cross-sectional view thereof taken substantially along line 3—3 of FIG. 1.

The upper threaded end 124 of differential screw 108 is complementally received in an internally threaded passage 126 through an adjustment block 128 secured to a corresponding plate portion 12*a* above a respective slit 50 as is evident from FIGS. 1 and 3. An extension 130 on block 128 is telescoped into an appropriate passage 132 therefor in plate 12*b* while a nut 134 over the outermost threaded end 136 of extension 130 holds block 128 on plate 12 but allows limited rotation thereof as may be necessary to accommodate slight swinging movement of differential screw 108 during adjustment of the latter. The uppermost end 138 of differential screw 108 is square to assist in rotation thereof with a conventional open end or 12 point socket wrench.

A channel-shaped indicator housing 140 partially encloses the upper threaded end 124 of differential screw 108 and is held thereon by retainer washers 142 and 144 releasably carried by screw 108. Housing 140 does not rotate with screw 108 during adjustment of the latter. The outermost front wall 140*a* of housing 140 has an elongated, upright slot 146 therein aligned with upper section 124 of screw 108. A series of indicator markings 148 along the length of slot 146 permit the operator to note the particular disposition of screw 108 including housing 140 relative to adjustment block 128 (or any other suitable indicia on the plate 12 or the associated structure shown and described.) Although the number of threads per inch of end sections 106 and 124 of screw 108 must be different as best shown in FIG. 3, the differential therebetween may be chosen to meet particular needs for a specific machine. Using a $\frac{5}{8}$ in. diameter screw for example, good results have been obtained where end section 124 has 11 threads per inch while end section 106 is provided with 18 threads per inch.

In operation, actuation of the air cylinder 38 (or the pair of such cylinders as the case may be) results in "throwing off" or bringing together of the blanket cylinders 14 and 16 as may be necessary or desirable. When the cylinders 14 and 16 have been brought into basically proper printing relationship with respect to the paper 42, however, conditions may warrant further fine adjustment of this relationship in order to achieve print quality of the desired level. Hence, upon loosening of the corresponding bolts 60 and 62 through plate 56 the operator may rotate screw 108 by applying a wrench to the square end 138 thereof. Such rotation results in shifting of the screw 108 relative to block 128 mounted on the upper section 12*b* of plate 12 against the drag of the plug 122*a* thereagainst. At the same time, rotation of the lower, more finely threaded section 106 of screw 108 effects displacement of the pivot block 100, but such movement is less than that of the upper end of the screw 108 relative to mounting block 128 because of the difference in the number of threads per inch of the screw between sections 106 and 124.

Figure 4:
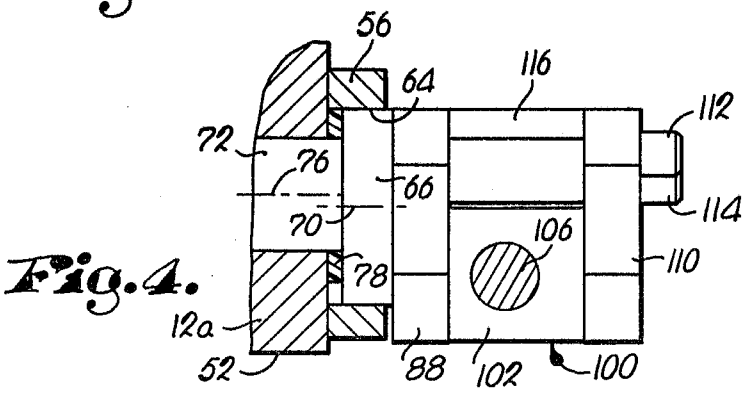
FIG. 4 is also an enlarged, fragmentary cross-sectional view taken substantially along the line 4—4 of FIG. 2.

If for example, following loosening of bolts 60 and 62, screw 108 is turned in a clockwise direction viewing FIG. 4, the result will be downward movement of the differential screw as coarse threaded section 124 rotates in the stationary block 128. Downward movement and concomitant rotation of the fine threaded end 106 effects downward displacement of pivot block 100 but the corresponding displacement of the latter is less than that of screw 108 relative to block 128 because of the difference in threads.

As the pivot block 100 is moved down by differential screw 108, force is applied to cam head 66 through block 88 thus rotating the cam part 66 within opening 64 in plate 56. By virtue of the crank action of screw 108 relative to pivot block 128 and the eccentric relationship of cam head 66 to shaft 72 integral therewith, downward movement of screw 108 causes cam head 66 to be eccentrically rotated in a counterclockwise direction viewing FIG. 1 about the axis 76 of shaft 72.

The net rotative displacement, then, of the cam head 66 in such counterclockwise direction results in a very minute amount of upward displacement of the axis 76 of shaft 72 because of the eccentricity of axis 76 with respect to the axis 70 and the mounting of cam head 66 in plate 56 which is fixedly secured to plate portion 12*b* by pin 58. Such movement of the axis 76, and hence shaft 72 upwardly to effect separation of plate portions 12*a* and 12*b*, is permitted by virtue of the slit 50 in that the force generated by rotation of the screw 108 is sufficient to overcome the yieldable resistance of portion 12*c* of the frame plate 12 and slightly open the slit 50. This manifestly slightly decreases the squeeze by the cylinders 14 and 16 on the paper 42. Rotation of the screw 108 in a direction opposite to that just described would, of course, result in an opposite slight adjustment of the cylinders 14, 16. The reason why rotation of screw 108 in a direction to effect downward movement thereof effects opening of the slit 50 is best understood when it is appreciated that rotative movement of pivot block 100 about the axis 76 of shaft 72 produces rotational movement of cam head 66 to which the block 100 is directly attached. The spacing between adjustment block 128 and shaft 72 is fixed. Thus, rotation of cam head 66 has the effect of exerting force on plate 56 in a downward direction. But since plate 56 is fixed to plate portion 12*b* and the latter is anchored to the floor, the resultant force vectors are upward, forcing plate portion 12*a* to move away from plate portion 12*b*.

As a result of rotation of the cam head 66 during axial displacement of the screw 108, the pivot block 100 has a slight horizontal component of movement with respect to the block 56. However, by virtue of the pivotal connection of screw 108 to plate portion 12*a* through adjustment block 128 and the swingable connection of plate 56 to plate portion 12*b* through pin 58, accommodation is provided for the crank action of screw 108 during rotation thereof in an appropriate direction both axially and radially. A retightening of the screws 60 and 62 returns the parts to a condition for printing without fear of accidentally disturbing the selected squeeze relationship between the cylinders 14 and 16. The operator may readily observe the relationship of block 128 to indicia 148 on housing 140 for record purposes to permit ready return thereto as desired or to note if the amount of change in blanket-to-blanket squeeze has been accomplished during a particular adjustment sequence.

It is important to note that although the range of adjustment by the mechanisms 46 and 48 is quite small, such adjustment is virtually infinite throughout the entirety of the range. The screw 108 may be rotated only to the extent required, and this results in a correspondingly minute adjustment of the squeeze relationship between cylinders 14 and 16. The differential threads on screw 108 are particularly effective to permit very fine adjustment of the squeeze relationship of the blankets in comparison with the extent of rotation of the screw 108. By way of example only, it is suggested that the pitch differential of the threaded sections 106 and 124, together with the other dimensional relationships of the mechanisms 46 and 48, be such that one complete revolution of the screw 108 results in two thousandth (0.002) of an inch change in the spacing between the blanket cylinders 14 and 16.

It is likewise important to recognize that the principles of this invention, while being described for convenience in connection with a pair of blanket cylinders 14 and 16 of a "perfecting" press, are not limited to use in conjunction with rolls of that particular type or a press of that particular type. It is wholly within the concepts of the present invention that the inventive principles herein described and claimed may find utility in conjunction with controlling the pressure between other rolls of the press, or even structures other than rolls wherein very minute, yet accurate and infinite adjustment is required.

We claim:

1. In a printing press having a pair of cooperable printing rolls operable to receive a paper web therebetween and mounted on a frame by structure which permits fine adjustment of the spatial relationship between said rolls comprising:

a pair of opposed plates each having an elongated slit extending inwardly from one edge thereof, only a part of the width of a corresponding plate, said slits being aligned and of approximately the same length;

means on each plate supporting one end of corresponding paper receiving rolls, one of said rolls being mounted on one side of said slits and the other roll being mounted on the opposite side of the slits; and selectively operable, manually manipulable mechanism adjustably carried by said plates in bridging relationship to said slits for positively prying opposed portions of the plates apart or pulling them together across said slits against the inherent, yieldable resistance derived from the integral connection of the plate portions at the terminal ends of the slits remote from the openings presented thereby to permit selective, controlled movement of the rolls slightly apart or toward each other to an extent as found necessary to compensate for differences in the thickness of paper passed between said rolls.

2. In a printing press, the improved combination of:

a pair of upright, spaced frame structures each having a monolithic mounting plate, said plates being positioned in horizontally spaced opposition;

a pair of cooperable printing rolls rotatably carried by the plates for passage of a substrate to be printed therebetween, said plates each having rigid portions integrally interconnected and supporting respective ends of opposed rolls with at least one portion of each plate being movable relative to the other through a limited displacement permitting adjustment of the relative position of the rolls; and manually manipulable mechanism joined to opposed portions of each plate and operable to permit positive shifting of at least one portion thereof toward and away from the other through a precise, selected distance against the inherent, yieldable resistance derived from their integral interconnection one to the other and to then fixedly hold the rolls in such disposition thus allowing finely controlled adjustment of the relative positions of the rolls to assure application of proper printing pressure on the particular substrate being passed therebetween.

3. In a printing press as claimed in claim 2, wherein said mechanism includes a cam operably interposed between said one and said other portions of each mounting plate for spreading the same or allowing return movement thereof when the cam is rotated.

4. In a printing press as claimed in claim 3, wherein each of said mounting plates has a slit extending from an edge of the mounting plate inwardly to a terminal point remote from said edge which thereby defines adjacent, opposed marginal edges of said portions, the latter being relatively spreadable toward and away from one another along said slit.

5. In a printing press as claimed in claim 3, wherein said mechanism includes a push-pull actuating member with one extremity of the actuating member being joined to one of the mounting plate portions while the other extremity is operably coupled to the cam which in turn is joined to the other of said mounting portions, said actuating member being operable to spread or pull the mounting plate portions toward each other across the slit in response to shifting movement of the actuating member.

6. In a printing press as claimed in claim 5, wherein said actuating member has a threaded connection at one end thereof with said one of the mounting plate portions and a threaded connection at the other end thereof with said cam, said member having threads of different pitch and the connections being such that rotation of the actuating member causes simultaneous axial movement thereof relative to the point of connection thereof to said one mounting plate portion and the cam respectively but at differing rates so as to produce a net differential of axial shifting of the actuating member and rotation of the cam thereby.

7. In a printing press as claimed in claim 6, wherein the threaded connection with said cam has a smaller thread pitch than the threaded connection with said one mounting plate portion, both of said threaded connections having the same direction of lead.

8. In a printing press as claimed in claim 3, wherein said mechanism further includes a cam support plate, said cam having a first part rotatable within said cam support plate about a first axis and a second part rotatable within one of said mounting plate portions about an axis eccentric to said first axis, said cam support plate being swingably secured to the other of said mounting plate portions whereby the eccentricity of said parts causes said relative shifting of the mounting plate portions when said cam is rotated.

9. In a printing press as claimed in claim 8, wherein said mechanism includes a push-pull actuating member eccentrically connected with said first part of the cam and is operably mounted to serve as a crank for effecting said rotation of the cam upon axial displacement of said crank member.

10. In a printing press as claimed in claim 9, wherein said actuating member is threadably mounted between structures on said mounting plate portions resulting in axial displacement thereof in response to rotation of the same.

11. In a printing press as claimed in claim 10, wherein said actuating member has a shank and a pair of components threadably receiving said shank at opposite ends thereof, one of said components being connected to said cam for effecting rotation thereof while the opposite end of the actuating member is joined by the other component to an opposed mounting plate portion, said components and the shank being threadably constructed and so threadably interrelated that rotation of the shank causes simultaneous extension of the shank from one component and retraction of the shank into the other component but at differing rates so as to produce a net differential of rotation of the cam in response to the extent of axial displacement of the actuating member.

12. In a printing press as claimed in claim 11, wherein said one component is secured to said one portion of the mounting plate and the other component is secured to said first part of the cam.

13. In a printing press as claimed in claim 8, wherein said actuating member is secured to said one mounting plate portion in a manner to preclude transverse movement thereof relative to and during rotation of said cam, said cam support plate being swingable on said other mounting plate portion during said rotation of the cam to compensate for relative transverse movement between the actuating member and the axis of said first part of the cam.

* * * * *